US006692414B1

(12) United States Patent
Gelbart et al.

(10) Patent No.: US 6,692,414 B1
(45) Date of Patent: Feb. 17, 2004

(54) SEAT BOUND EXERCISE SYSTEM PROVIDING RESISTIVE ROTARY MOTION OF THE ANKLE

(76) Inventors: Ida Gelbart, 129 Meadowcreek Dr., Corte Madera, CA (US) 94925; S. Samuel Gelbart, 164 Janes St., Mill Valley, CA (US) 94941; Mark E. Goldman, 309 Riviera Dr., San Rafael, CA (US) 94901-1528

( * ) Notice: Subject to any disclaimer, the term of this patent is extended or adjusted under 35 U.S.C. 154(b) by 274 days.

(21) Appl. No.: 09/875,655

(22) Filed: Jun. 6, 2001

(51) Int. Cl.[7] ..... A63B 21/008; A63B 21/02
(52) U.S. Cl. ..... 482/112; 482/121
(58) Field of Search ..... 482/111–113, 51–53, 482/77, 34–35, 121, 124

(56) References Cited

U.S. PATENT DOCUMENTS 5,129,873 A * 7/1992 Henderson et al. ..... 482/52
5,336,142 A * 8/1994 Dalebout et al. ..... 482/52
5,490,818 A * 2/1996 Haber et al. ..... 482/52
5,622,527 A * 4/1997 Watterson et al. ..... 482/53
5,803,880 A * 9/1998 Allen ..... 482/113
5,944,637 A * 8/1999 Stickler et al. ..... 482/61

* cited by examiner

*Primary Examiner*—Nicholas D. Lucchesi
*Assistant Examiner*—Fenn C Mathew
(74) *Attorney, Agent, or Firm*—Edward P. Dutkiewicz

(57) ABSTRACT

A seat bound exercise system provides resistive rotational motion of the ankle to combat potentially fatal problems such as lower leg thrombosis. The system comprises an attachment member with upper and lower ends. The lower end is provided with a bore and extends to a ground surface. A support cylinder with a top end, a bottom end, an inner edge and an outer edge is provided. The bottom end has a coaxial bore allowing rotatable coupling with a bore of the attachment members with a pin. A handle bar, including a cylindrical receiving bar and a cylindrical intermediate portion, is provided next. The receiving bar has a lower portion telescoping over and coupled to the top ends of the support cylinders and upper portion. The intermediate bar telescopes over and is coupled to the receiving bar. Also included is a source of resistance force with piston rods. A foot pedal with a foot receiving portion is provided.

3 Claims, 7 Drawing Sheets

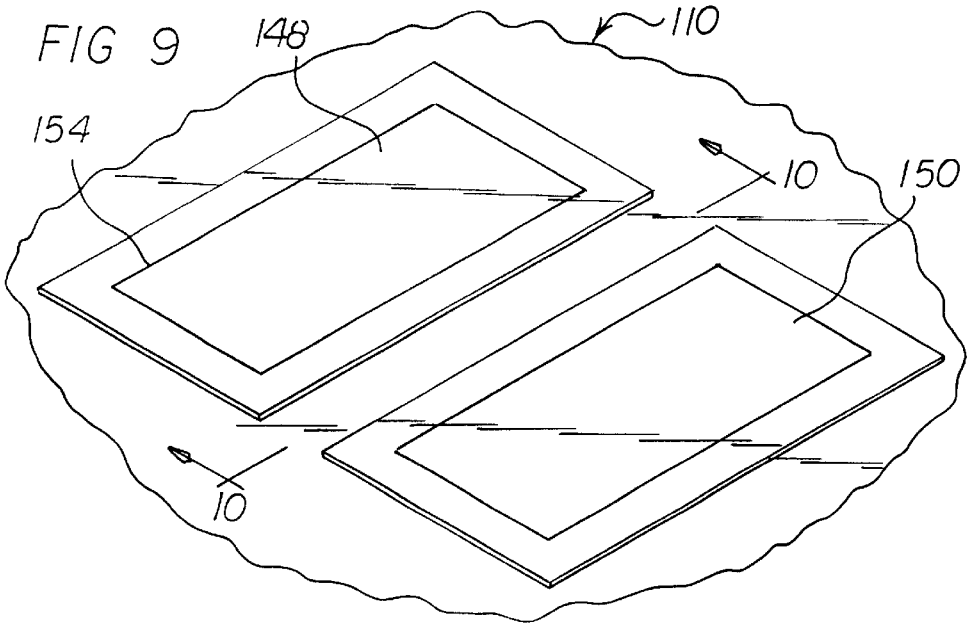
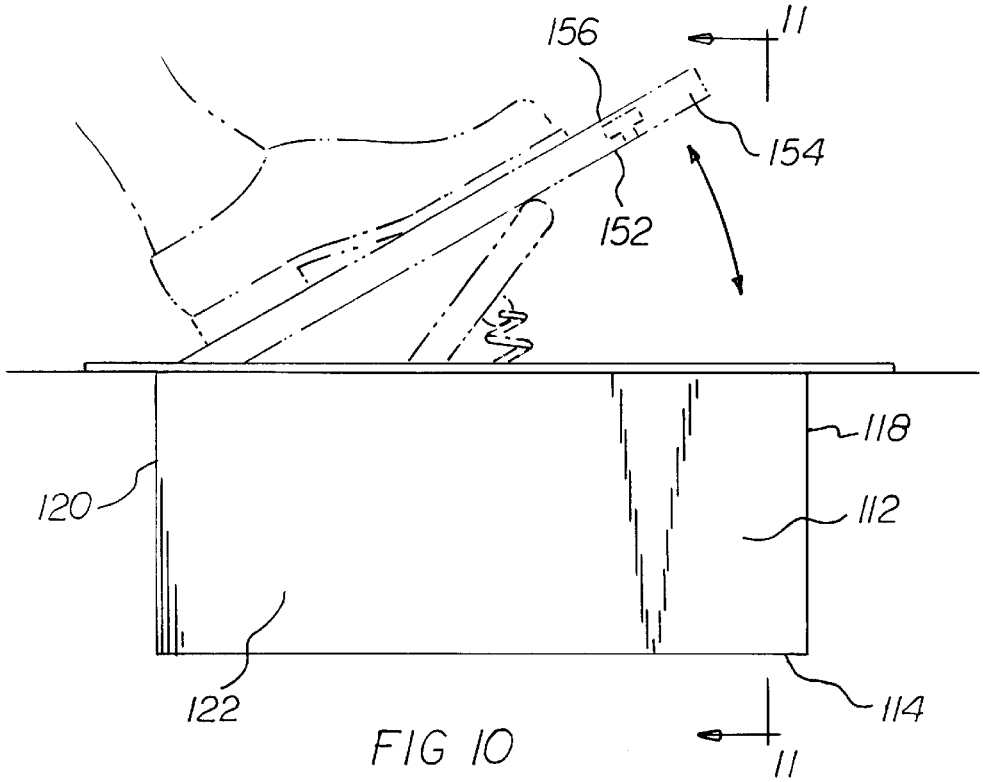
FIG 10

FIG 11
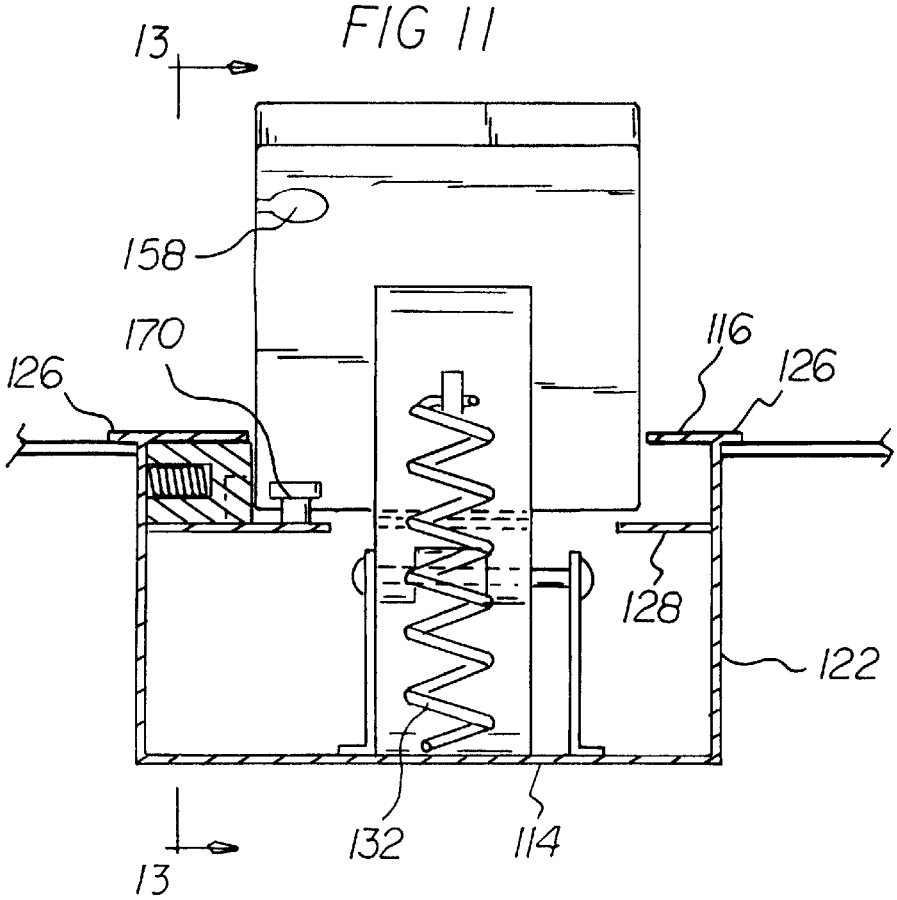
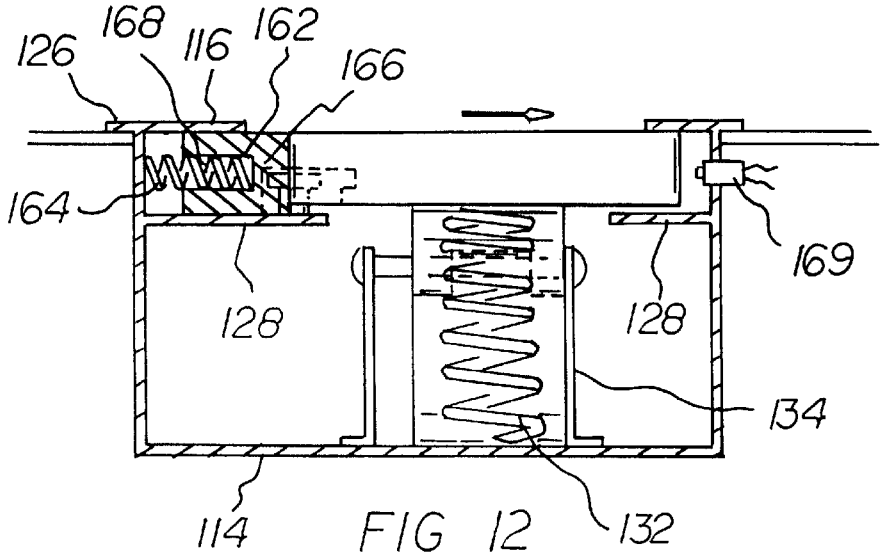
FIG 12

SEAT BOUND EXERCISE SYSTEM PROVIDING RESISTIVE ROTARY MOTION OF THE ANKLE

BACKGROUND OF THE INVENTION

1. Field of the Invention

The present invention relates to a seat bound exercise system and more particularly pertains to allowing passengers to engage in exercise of the type requiring resistance rotation of the ankle while seated during travel. Such exercise combats such potentially fatal problems as lower leg thrombosis.

2. Description of the Prior Art

The use of exercise devices of known designs and configurations is known in the prior art. More specifically, exercise devices of known designs and configurations previously devised and utilized for the purpose of exercising through conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,013,287 to Dickman discloses a leg exerciser and foot rest for automotive vehicles. U.S. Pat. No. 4,204,675 to McGinnis discloses an air chamber leg exercising device. U.S. Pat. No. 5,312,315 to Mortenson discloses a pneumatic variable resistance rehabilitation/therapy apparatus. U.S. Pat. No. 6,066,076 to Wang discloses a stepping exerciser. Lastly, U.S. Pat. No. 6,152,855 to Dean discloses an in-bed exercise machine and method of use.

While these devices fulfill their respective, particular objectives and requirements, the aforementioned patents do not describe a seat bound exercise system allowing passengers to engage in exercise while seated during travel.

In this respect, the seat bound exercise system according to the present invention substantially departs from the conventional concepts and designs of the prior art, and in doing so provides an apparatus primarily developed for the purpose of allowing passengers to engage in exercise while seated during travel.

Therefore, it can be appreciated that there exists a continuing need for a new and improved seat bound exercise system which can be used for allowing passengers to engage in exercise while seated during travel. In this regard, the present invention substantially fulfills this need.

SUMMARY OF THE INVENTION

In view of the foregoing disadvantages inherent in the known types of exercise devices of known designs and configurations now present in the prior art, the present invention provides an improved seat bound exercise system. As such, the general purpose of the present invention, which will be described subsequently in greater detail, is to provide a new and improved seat bound exercise system and method which has all the advantages of the prior art and none of the disadvantages.

To attain this, the present invention essentially comprises a seat. The seat is secured above a load bearing surface. The seat is adapted for a user while sitting during exercise with a limited amount of room in front of the seat. The exercise is of the type requiring the user's legs to be extended in front of him and the load bearing surface to be in front of the seat.

It is preferred that two seats are utilized, a rearward seat upon which the exercising person sits and a forward seat supporting the exercising system. Also provided is a pair of laterally attachment members. Each attachment member has an upper end and a lower end. The lower ends extend to the load bearing surface. Axially spaced bores are provided through the lower ends of the attachment members. In this manner, the bores lie along a common axis. Next provided is a pair of support cylinders. Each support cylinder has a top end, a bottom end, an inner edge and an outer edge. Coaxial bores with pivot pins are provided through the bottom ends. This arrangement allows for the rotatable coupling of the support cylinders with respect to the attachment member through the alined bores when attached by the pins. The support cylinders have slots along the inner edges. Each slot has an elongated component which runs parallel with the cylinders and its associated slot. The slots each have an upper edge and a lower edge. The upper edges include short circumferential segments which extend about 90 degrees to allow for stowing the system beneath the forward seat when not in use. Provided next is a handle bar in an inverted U-shaped configuration. The handle bar is comprised of a pair of cylindrical L-shaped receiving bars and a cylindrical linear intermediate portion. The receiving bars have lower portions adapted to telescope over and couple to the top ends of the support cylinders. The receiving bars have upper portions. The upper portions bend perpendicularly toward each other. A laterally extending horizontal space is provided between the upper portions. A source of resistance force is also provided. The source of resistance forces is comprised of a pair of pistons. Each piston has an air chamber. Each air chamber has an air nozzle. Each air chamber also has a piston rod opposite the air nozzle. The piston is coupled to the intermediate portion of the interior of the support cylinder. The piston rod points downwardly and is retained in place by a second spring. A pair of flexible tubes is operatively coupled to the nozzles. The flexible tubes run to an upper portion of the handle bars. A pair of connectors is provided. Each connector has a first end. Each first end of each connector is rotatably coupled to the piston rod. A second end is also provided. Each second end is provided perpendicular to the first end. Each second end has a threaded aperture. Each second end is adapted to fit through the slot of the support cylinders. Further provided is an adjustment member. The adjustment member comprises a valve. The valve has opposed ends. The opposed ends are coupled to the flexible tube. The adjustment member resides in the handle bar. A knob passes through the intermediate portion. In this manner, the user is able to control the flow of air between the pistons to consequently control the resistance of the pistons. Provided last is a pair of foot pedals. Each foot pedal has a foot receiving portion. A bore passes through the foot receiving portion. A spring loaded threaded coupler also passes through the foot receiving portion. The spring loaded threaded coupler is received in the second end of the connector on the piston rod. In this manner, the user is able to control the rotation of the pedals around the threaded coupler. The connector passes through the upper edge of the slot, allowing the pedals to point away from the user. This position allows the pedals to be stored.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved seat bound exercise system which has all of the advantages of the prior art exercise devices of known designs and configurations and none of the disadvantages.

It is another object of the present invention to provide a new and improved seat bound exercise system which may be easily and efficiently manufactured and marketed.

It is further object of the present invention to provide a new and improved seat bound exercise system which is of durable and reliable constructions.

An even further object of the present invention is to provide a new and improved seat bound exercise system which is susceptible of a low cost of manufacture with regard to both materials and labor, and which accordingly is then susceptible of low prices of sale to the consuming public, thereby making such seat bound exercise system economically available to the buying public.

Even still another object of the present invention is to provide a seat bound exercise system for allowing passengers to engage in exercise while seated during travel.

Lastly, it is an object of the present invention to provide a new and improved seat bound exercise device is comprising an attachment member with upper and lower ends. The lower end is provided with a bore and extends to a load bearing surface. A support cylinder with a top end, a bottom end, an inner edge and an outer edge is provided. The bottom end has a coaxial bore allowing rotatable coupling with a bore of the attachment members with a pin. A handle bar, including a cylindrical receiving bar and a cylindrical intermediate portion, is provided next. The receiving bar has a lower portion telescoping over and coupled to the top ends of the support cylinders and upper portion. The intermediate bar telescopes over and is coupled to the receiving bar. Also included is a source of resistance force with piston rods. A foot pedal with a foot receiving portion is provided.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is a perspective view of an alternative embodiment of the present invention.

FIG. 10 is a side elevational view of the alternative embodiment of the present invention illustrating in dashed lines the pedal raised.

FIG. 11 is a cross-sectional view of housing of the alternative embodiment taken along line 11—11 of FIG. 10 and with the pedal raised.

FIG. 12 is a cross-sectional view of housing of the alternative embodiment similar to FIG. 11, but with the pedal lowered.

The same reference numerals refer to the same parts throughout the various Figures.

DESCRIPTION OF THE PREFERRED EMBODIMENT

Figure 1:
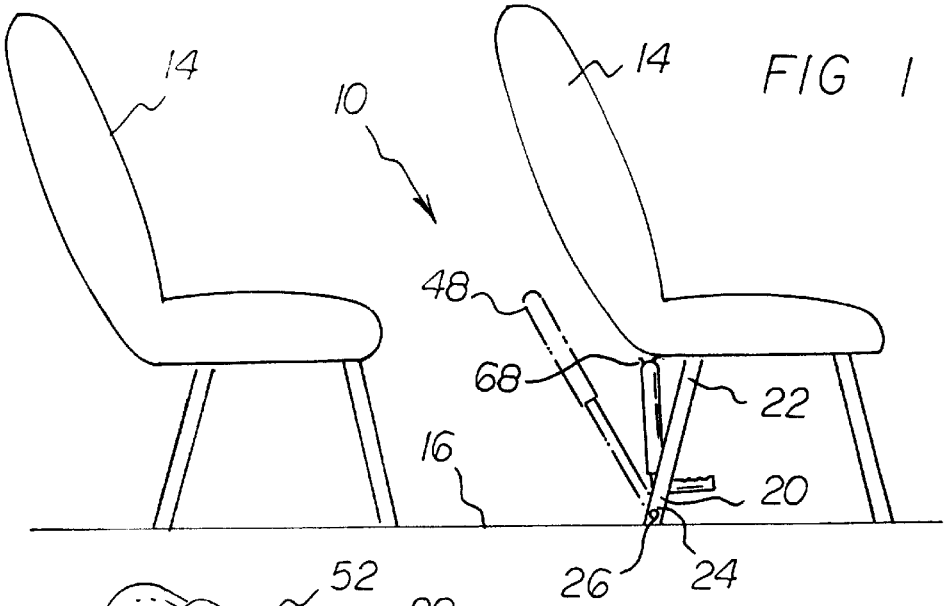
FIG. 1 is a side elevational view of the preferred embodiment of the present invention operable between two seats.
Figure 2:
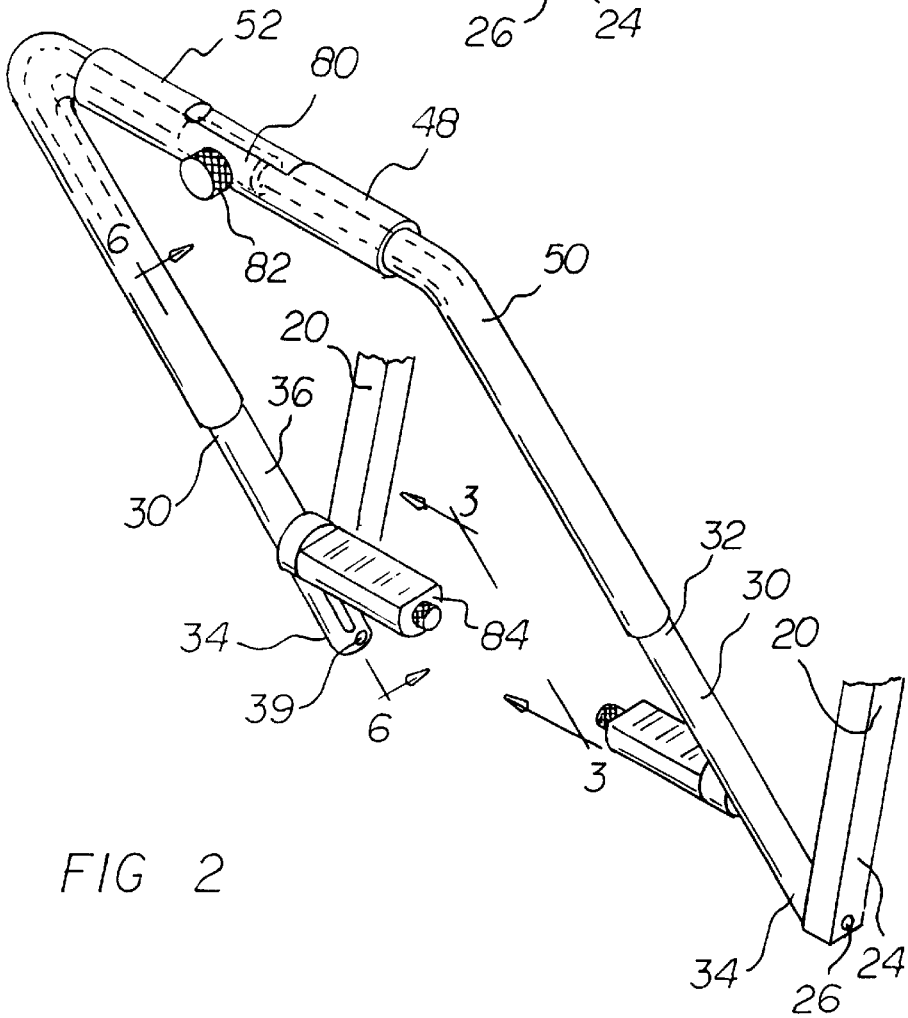
FIG. 2 is a perspective illustration of the central components of the present invention.
Figure 3:
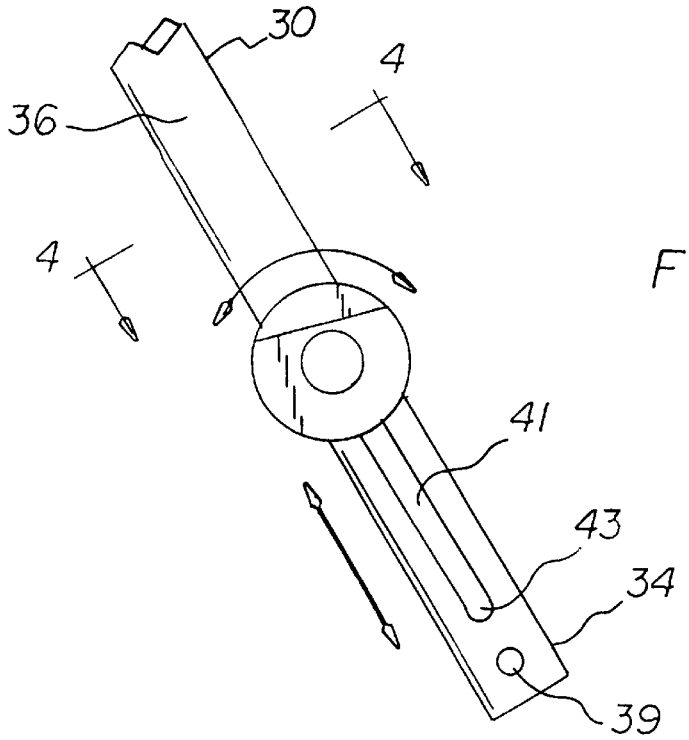
FIG. 3 is a side elevational view of the foot pedal of the present invention taken along line 3—3 of FIG. 2.
Figure 4:
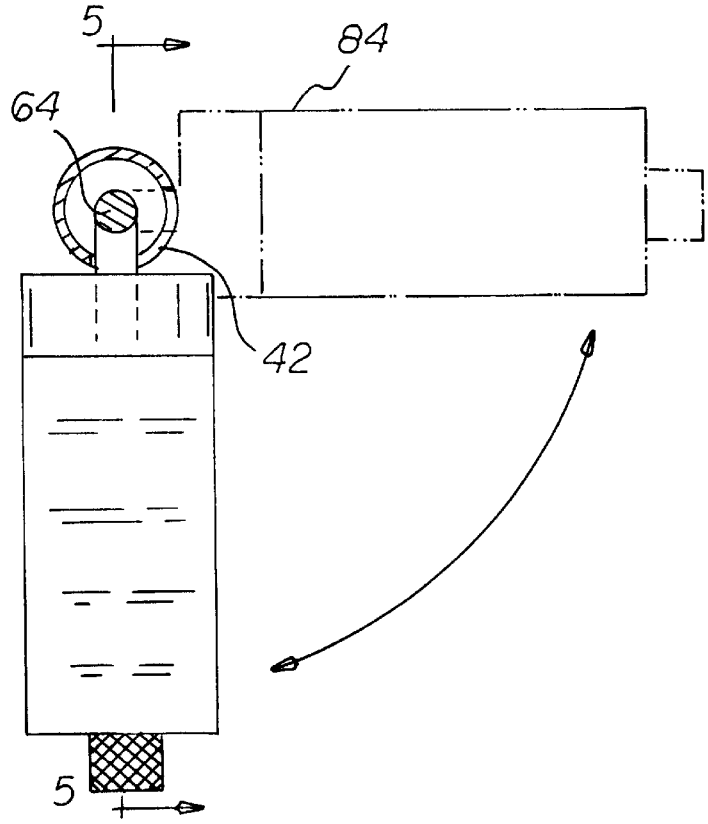
FIG. 4 is a cross-sectional view of the foot pedal of the present invention taken along line 4—4 of FIG. 3.
Figure 5:
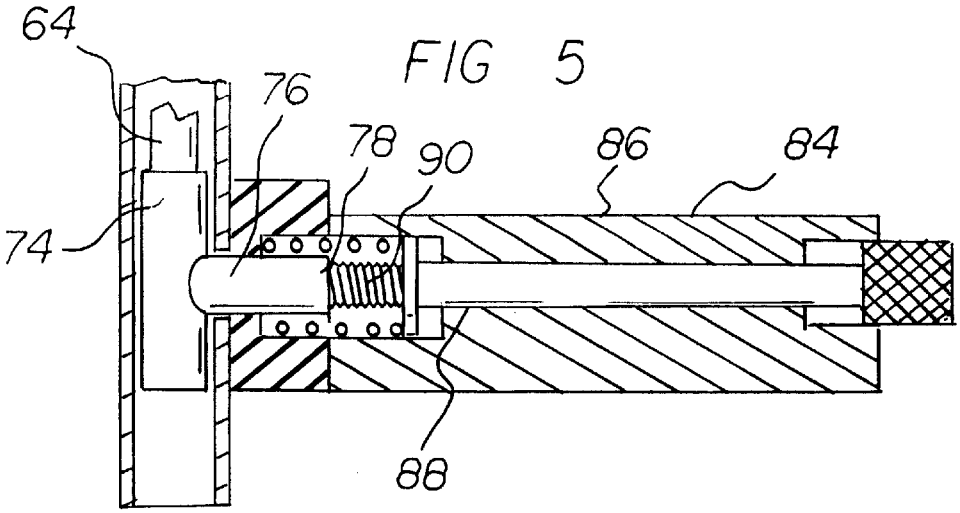
FIG. 5 is a cross-sectional view of the foot pedal taken along line 5—5 of FIG. 4.
Figure 6:
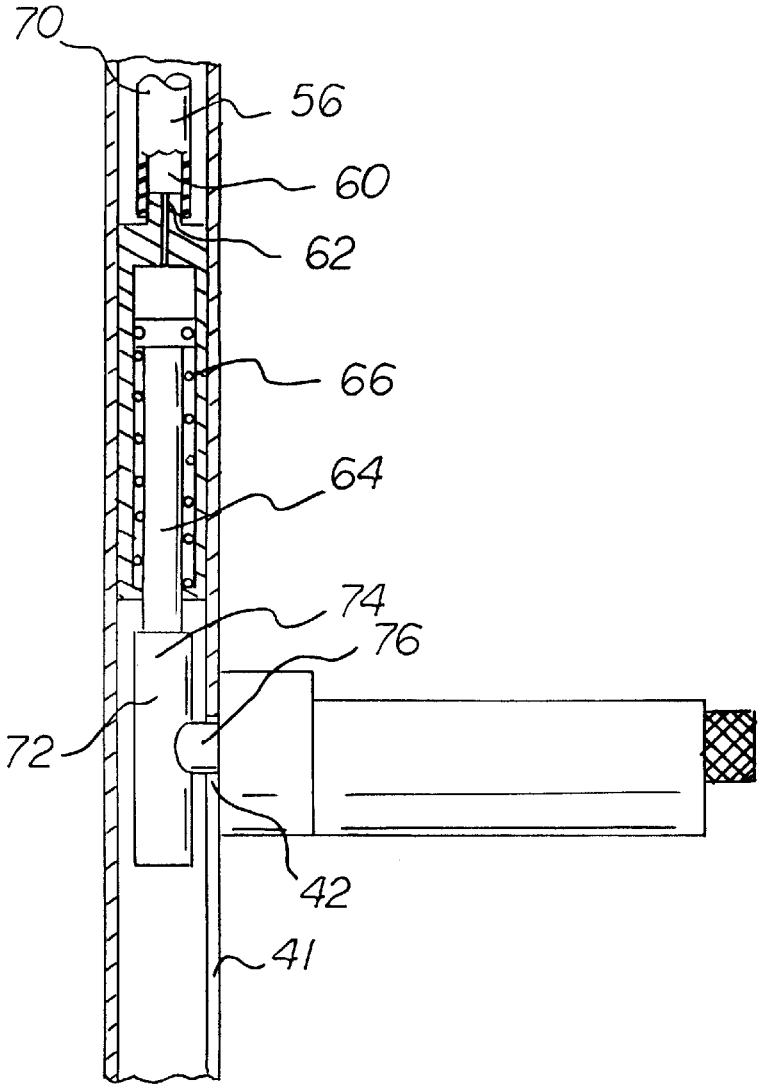
FIG. 6 is a cross-sectional view of the support cylinders taken along line 6—6 of FIG. 2.

With reference now to the drawings, and in particular to FIG. 1 thereof, the preferred embodiment of the new and improved seat bound exercise system embodying the principles and concepts of the present invention and generally designated by the reference numeral 10 will be described.

The present invention, the seat bound exercise system 10 is comprised of a plurality of components. Such components in their broadest context include an attachment member, a support cylinder, a handle bar, a source of resistance force and a foot pedal. Such components are individually configured and correlated with respect to each other so as to attain the desired objective.

First provided is a seat 14. The seat is secured above a floor functioning as a load bearing surface 16. The seat is adapted for a user while sitting during exercise with a limited amount of room in front of the seat. The exercise is of the type requiring the user's legs to be extended in front of him with the load bearing surface located beneath and in front of the seat. It is preferred that two seats are utilized, a rearward seat upon which the exercising person sits and a forward seat supporting the exercising system.

Provided next is a pair of laterally spaced attachment members 20 preferably formed as the legs of the forward seat. Each attachment member has an upper end 22 and a lower end 24. The lower ends extend downwardly to the load bearing surface. Axially spaced bores 26 is provided through the lower ends of the attachment members. In this manner, the bores lie along a common axis.

Next provided is a pair of support cylinders 30. Each support cylinder has a top end 32, a bottom end 34, an inner edge 36 and an outer edge 38. Coaxial bores 39 with pivot pins are provided through the bottom ends. This arrangement allows for the rotatable coupling of the support cylinders with respect to the attachment member through the alined bores when attached by the pins. The support cylinders have slots 41 along the inner edges. Each slot has an elongated compartment which run parallel with the cylinders and its associated slot. The slots each have an upper edge 42 and a lower edge 43. The upper edges include short circumferential segments, which extend about 90 degrees to allow for stowing the system beneath the forward seat when not in use.

Provided next is a handle bar 48 in an inverted U-shaped configuration. The handle bar is comprised of a pair of cylindrical L-shaped receiving bars 50 and a cylindrical linear intermediate portion 52. The receiving bars have lower portions adapted to telescope over and couple to the top ends of the support cylinders. The receiving bars have upper portions. The upper portions bend perpendicularly toward each other. A laterally extending horizontal space is provided between the upper portions. The intermediate portion is adapted to telescope over and couple both upper portions of the receiving bars.

A source 56 of resistance force is also provided. The source of resistance forces is comprised of a pair of pistons 58. Each piston has an air chamber 60. Each air chamber has an air nozzle 62. Each air chamber also has a piston rod 64 opposite the air nozzle. The piston is coupled to the intermediate portion of the interior of the support cylinder. The piston rod points downwardly and is retained in place by a second spring 66. This second spring keeps the handle bar extended during an operative state, but allows the handle bar to be compressed over the support cylinders when in a stowed state and held in place by a retention member 68 attached to a bottom surface of the forward seat. A pair of flexible tubes 70 is operatively coupled to the nozzles. The flexible tubes run to an upper portion of the handle bars. A pair of connectors 72 is provided. Each connector has a first end 74. Each first end of each connector is rotatably coupled to the piston rod. A second end 76 is also provided. Each second end is provided perpendicular to the first end. Each second end is adapted to fit through the slot of the support cylinders. Each second end has a threaded aperture 78.

Further provided is an adjustment member. The adjustment member comprises a valve 80. The valve has opposed ends. The opposed ends are coupled to the flexible tube. A knob 82 passes through the intermediate portion of the handle bar. In this manner, the user is able to control the flow of air between the pistons to consequently control the resistance of the pistons.

Provided lastly is a pair of foot pedals 84. Each foot pedal has a foot receiving portion 86. A bore 88 passes through the foot receiving portion. A spring loaded threaded coupler 90 also passes through the foot receiving portion. The spring loaded threaded coupler is received in the second end of the connector on the piston rod. In this manner, the user is able to control the rotation of the petals about the threaded coupler. The connector passes through the upper edge of the slot, allowing the pedals to point away from the user. This position allows the pedals to be stored.

Figure 7:
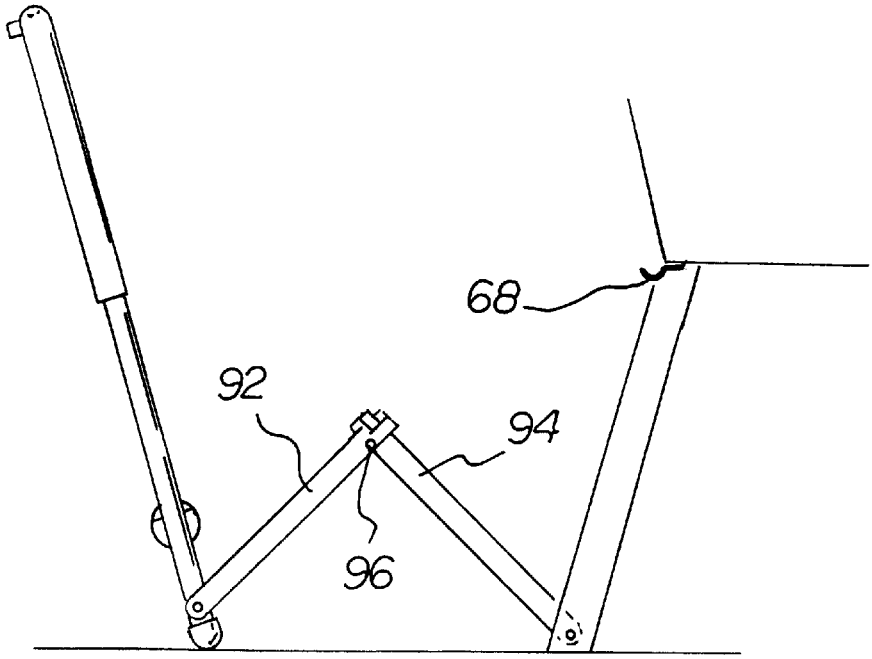
FIG. 7 is a side elevational view of the present invention with extension members.
Figure 8:
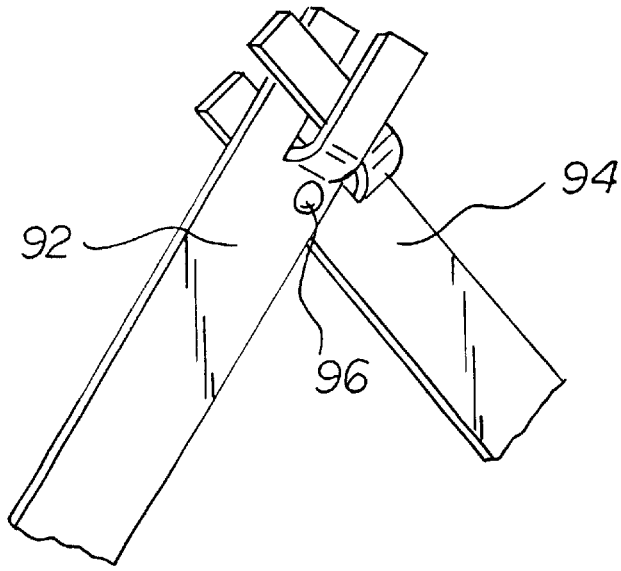
FIG. 8 is perspective view of the pivot point of the extension members shown in FIG. 7.
Figure 13:
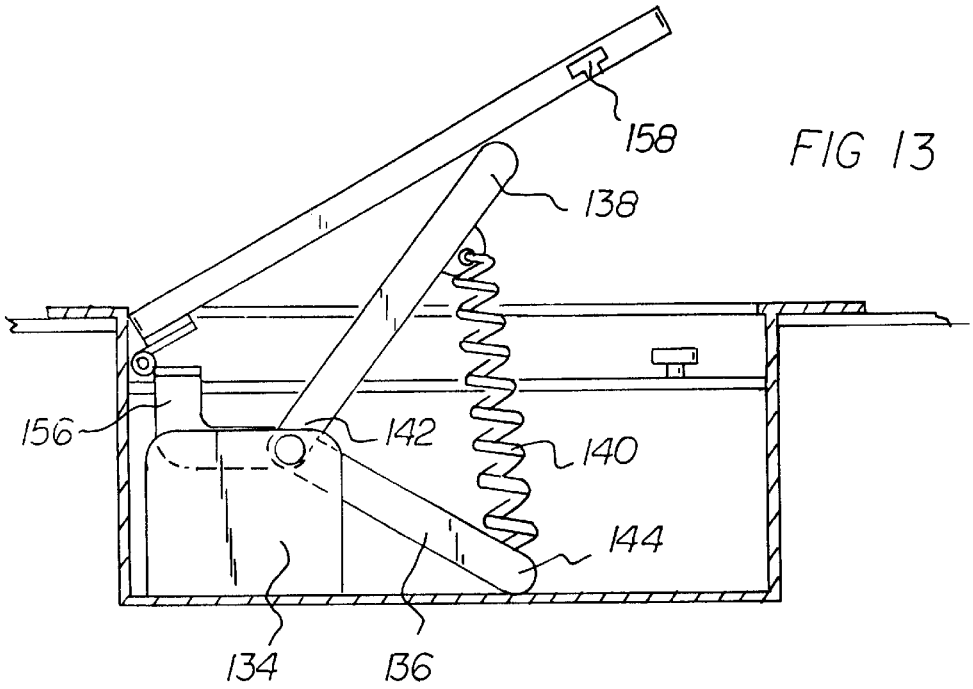
FIG. 13 is a cross-sectional view of housing of the alternative embodiment taken along line 13—13 of FIG. 12.
Figure 14:
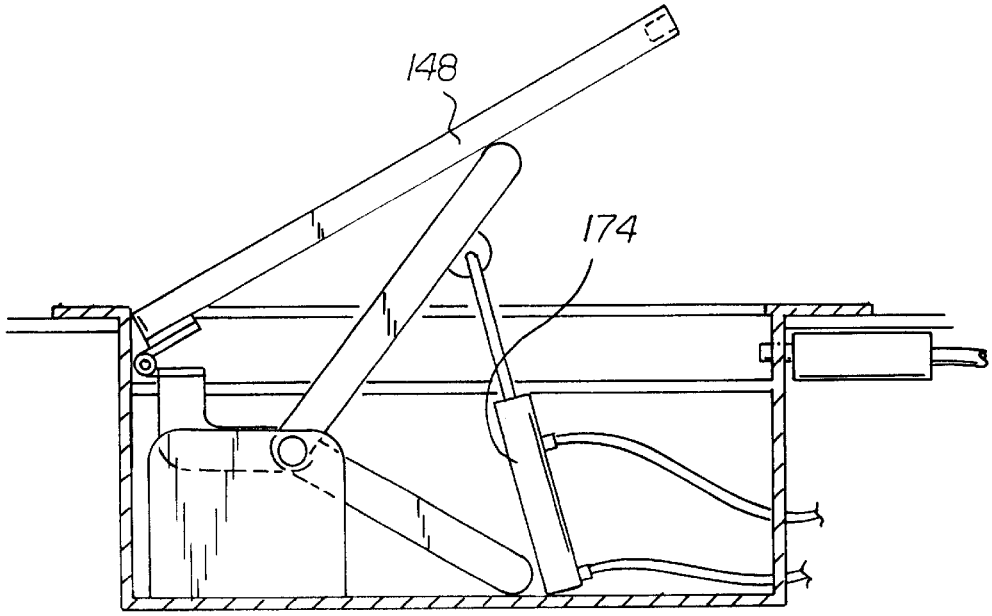
FIG. 14 is a cross-sectional view of housing similar to FIG. 13 but showing alternative compression assembly.

A variation of the primary embodiment is shown in FIGS. 7 and 8. In such embodiment, a pair of laterally spaced links 92 and 94 are coupled at a central pin 96. The ends of the links are pivotally coupled to the attachment members 20 and support cylinders 30 for allowing exercising at varying distances from the user's seat.

An alternate embodiment of the present invention is shown in FIGS. 9–14. In such embodiment a seat bound exercise system 110 is disclosed for use by a passenger wanting to engage in exercise while seated during travel. The seat bound exercise system includes a pair of housings 112. Each housing has a base 114, a top face 116, a front wall 118, a rear wall 120 and a pair of side walls 122. The top face has a rectangular aperture 124. The aperture has an internal edge. The top face has a lip 126. The lip extends externally past the walls. The housing also has a pair of ledges 128. The pair of ledges is provided below the top face. The pair of ledges attaches to the side walls. The ledges end at the front and rear wall. The ledges extend past the internal edge of the aperture of the top face.

Included in this alternate embodiment is pair of compression assemblies 132 in each housing. Each compression assembly has a support base 134, an upper arm 136, a lower arm 138 and a spring 140. The support base is coupled to the base of the housing adjacent the rear wall. Both arms have an inner end 142 and an outer end 144. All ends are beveled. The inner ends are pivotably coupled to the base. In this manner horizontal motion of the assembly is provided between the two side walls. The spring is coupled between the outer ends of the upper and lower arms.

A pair of foot receiving platforms 148 is included. Each foot receiving platform has a rectangular configuration. Each platform has a top face 150, a bottom face 152 and a pair of side edges 154 between the top and bottom faces. The platform is pivotably coupled to a brace arm 156. The brace arm is rigidly coupled to the support base. In this manner the platform lies adjacent to the upper arm of the compression assembly. The platform has a retention aperture 158. The retention aperture is on the bottom face adjacent the side edge. The platform has a first state when the spring is fully extended. The platform has a second state when the platform is lying parallel and between the ledge and the top face of the housing.

Also included in this alternate embodiment is a pair of spring loaded locking members 162. Each spring loaded locking member has a supplemental spring 164 and a block 166. Only one spring 164 is shown, but a plurality of laterally disposed springs, as for example two, or preferably three, could be utilized. The block has a cylindrical bore 168. The supplemental spring is coupled to one of the side walls between the ledge and the top face. The supplemental spring is also coupled to the bore of the block. When the platform is in its second state the block can slide the platform horizontally on the support base to be retained between the top face and ledge of the opposite side. A retention knob 170 is coupled to the ledge adjacent the block. The retention knob is adapted to be received in the retention aperture of the platform. In this manner, the platform is held in the second state. The block is able to be adapted to reside around the supplemental spring and between the top face and ledge of the housing while the system is in use.

Movement of the block 166 against the spring 164 in a direction opposite from the arrow may be caused by an operator controlled solenoid 169 shown in FIG. 12. Only one solenoid is shown but a plurality of laterally disposed solenoids, as for example two, or preferably three, could be utilized. All of the solenoids are concurrently actuated by a common source.

The rotary motion of the ankle under resistance, as provided by the present invention, is of a therapeutic value in fighting lower leg thrombosis.

In an alternate embodiment the locking members can be a pair of pneumatic pistons 174 adapted to retain the foot receiving platforms, wherein the foot receiving platforms have an aperture in the side edges to receive the pneumatic piston. Such pistons essentially replace the function of springs 132.

In a further alternate embodiment of the present invention the resistance force can also come from electronic means, pneumatic means, controllable cylinders as well as springs.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A seat bound exercise device comprising:

an attachment member with a lower end extending to a load bearing surface, the lower end having a bore there through;

a pair of support cylinders each having a top end, a bottom end, an inner edge and an outer edge, each bottom end having a coaxial bore allowing rotatable coupling with a bore of the associated attachment member with a pin there between, each of the support cylinders having a slot along the inner edge and running parallel with the cylinder and its associated slot, each slot having an upper edge and a lower edge with the upper edge extending perpendicularly toward a load bearing surface and away from the user with the upper edge having a segment which extends 90 degrees;

a handle bar including a cylindrical receiving bar and a cylindrical intermediate portion, the receiving bar having a lower portion telescoping over and coupled to the top ends of the support cylinders and upper portion, the intermediate bar telescoping over and coupled to the receiving bar;

a source of resistance force having piston rods; and a pair of foot pedals each having a foot receiving portion with a spring loaded threaded coupler passing through the associated foot receiving portion and being received on the associated piston rod.

2. A seat bound exercise system as set forth in claim 1 and further comprising:

a pair of laterally spaced links coupled at a central pin, with the ends of the links pivotally coupled to the attachment members and support cylinders for allowing exercising at varying distances from the seat.

3. A seat bound exercise system for allowing passengers to engage in exercise of the type requiring resistance rotation of the ankle while seated during travel comprising, in combination:

a seat secured above a load bearing surface and being adapted for a user while sitting during exercise with a limited amount of room in front of the seat, the exercise being of the type requiring the extending of a user's legs and with the seat having the load bearing surface in front of it and further providing a seat for the user;

a pair of laterally spaced attachment members each having an upper end and a lower end, the lower ends extending downwardly to the load bearing surface, the lower ends of the attachment members having a bore there through such that both bores lie in a common axis;

a pair of support cylinders each having a top end, a bottom end, an inner edge and an outer edge, the bottom ends having coaxial bores with pivot pins there through allowing rotatable coupling with the support cylinders with respect to the attachment members through the aligned bores when attached by the pins, the support cylinders having slots along the inner edges with an elongated component which runs parallel with the cylinders and its associated slot, the slots each having an upper edge and a lower edge with the upper edges including short circumferential segments which extends about 90 degrees to allow for stowing the system beneath the forward seat when not in use;

a U-shaped handle bar comprising a pair of L-shaped cylindrical receiving bars and a cylindrical linear intermediate portion, the receiving bars having lower portions being adapted to telescope over and couple to the top ends of the support cylinders and upper portions that bend perpendicularly towards each other with a laterally extending horizontal space there between, the intermediate portion being adapted to telescope over and couple both upper portions of the receiving bars;

a source of resistance force comprising a pair of pistons each having an air chamber with an air nozzle and a piston rod opposite the air nozzle, the piston being coupled to the intermediate portion of the interior of the support cylinder with the piston rod pointing downwardly and retained in place by a second spring, and a pair of flexible tubes operatively coupled to the nozzles and running to an upper portion of the handle bars, and a pair of connectors each having a first end rotatably coupled to the piston rod having a second end perpendicular to the first end, the second end having a threaded aperture and adapted to fit through the slot of the support cylinders;

an adjustment member comprising a valve with opposed ends coupled to the flexible tube from the pistons, the adjustment member residing in of the intermediate portion of the handle bar with a knob passing through the intermediate portion and thereby allowing the user to control the flow of air between the pistons to consequently control the resistance of the pistons; and a pair of foot pedals, each having a foot receiving portion with a bore passing there through and with a spring loaded threaded coupler passing through the foot receiving portion and being received in the second end of the connector on the piston rod, thereby enabling the user to control the rotation of the pedals around the threaded coupler, the pedals being adapted to be stored when the connector passes through the upper edge of the slot thereby allowing the pedals to point away from the user.

* * * * *